US008057977B2

(12) United States Patent
Moribe et al.

(10) Patent No.: US 8,057,977 B2
(45) Date of Patent: Nov. 15, 2011

(54) TONER

(75) Inventors: Syuhei Moribe, Numazu (JP); Katsuhisa Yamazaki, Numazu (JP); Daisuke Yoshiba, Suntou-gun (JP); Masami Fujimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 489 days.

(21) Appl. No.: 12/268,504

(22) Filed: Nov. 11, 2008

(65) Prior Publication Data

US 2009/0123859 A1 May 14, 2009

(30) Foreign Application Priority Data

Nov. 12, 2007 (JP) ..... 2007-293065

(51) Int. Cl.
*G03G 9/08* (2006.01)

(52) U.S. Cl. ..... 430/108.1; 430/108.24; 430/108.6

(58) Field of Classification Search ..... 430/108.1, 430/108.24, 108.6
See application file for complete search history.

(56) References Cited

U.S. PATENT DOCUMENTS

| | | | | |
|---|---|---|---|---|
| 6,156,471 | A | 12/2000 | Kobori et al. | 430/110 |
| 7,273,686 | B2 | 9/2007 | Onuma et al. | 430/110.3 |
| 2001/0000743 | A1 * | 5/2001 | Yuasa et al. | 430/110 |
| 2002/0061457 | A1 * | 5/2002 | Okuno et al. | 430/108.6 |
| 2003/0059700 | A1 * | 3/2003 | Konya et al. | 430/108.6 |
| 2003/0190546 | A1 | 10/2003 | Yoshino et al. | 430/124 |
| 2003/0219667 | A1 * | 11/2003 | Matsumoto et al. | 430/108.7 |
| 2004/0185361 | A1 * | 9/2004 | Yoshino et al. | 430/108.1 |
| 2004/0229040 | A1 * | 11/2004 | Kudo et al. | 428/405 |
| 2007/0218387 | A1 * | 9/2007 | Ishii et al. | 430/108.7 |
| 2008/0124643 | A1 | 5/2008 | Yoshiba et al. | 430/108.7 |

FOREIGN PATENT DOCUMENTS

| | | |
|---|---|---|
| JP | 05-273785 | 10/1993 |
| JP | 2002-287414 | 10/2002 |
| JP | 2003-066637 | 3/2003 |
| JP | 2003-091223 | 3/2003 |

OTHER PUBLICATIONS

Patent Abstracts of Japan for JP 02-221964, Sep. 4, 1990.

* cited by examiner

*Primary Examiner* — Hoa Le
(74) *Attorney, Agent, or Firm* — Fitzpatrick, Cella, Harper & Scinto

(57) ABSTRACT

Provide is a toner including toner particles each containing at least a binder resin and a colorant, and an inorganic fine powder, in which the inorganic fine powder has a ratio (A/B) of a total pore volume A measured in a pore diameter range of from 1.9 nm or more and to 8.0 nm or less to a total pore volume B measured in a pore diameter range of from 1.9 nm or more and to 300.0 nm or less of from 0.20 or more and to 1.00 or less, and the total pore volume A is from $1.00\times10^{-2}$ $cm^3/g$ or more and to 1.00 $cm^3/g$ or less.

3 Claims, No Drawings

TONER

BACKGROUND OF THE INVENTION

1. Field of the Invention

The present invention relates to a toner to be used in an image-forming method or toner jet method for visualizing an electrostatic image in electrophotography.

2. Description of the Related Art

An electrophotographic method involves: charging an electrostatic latent image bearing member composed of a photoconductive substance by various means; exposing the charged electrostatic latent image bearing member to light to form an electrostatic latent image on the surface of the electrostatic latent image bearing member; developing the electrostatic latent image with toner to form a toner image; transferring the toner image onto a transfer material such as paper; and fixing the toner image on the transfer material with one or both of heat and pressure to provide a copied article or print.

When such image-forming process is repeated a large number of times, ozone produced in the charging step of charging the electrostatic latent image bearing member reacts with nitrogen in the air to form a nitrogen oxide ($No_x$), the so-called corona product. Further, such nitrogen oxide reacts with moisture in the air to form nitric acid, which adheres to the surface of the electrostatic latent image bearing member. As a result, the resistance of the surface of the electrostatic latent image bearing member reduces, and, at the time of image formation, image smearing serving as an image defect on the electrostatic latent image bearing member occurs; the phenomenon is particularly remarkable under a high-humidity environment.

By the way, nowadays, an output apparatus employing electrophotography, which has been conventionally used for personal-use purposes, begins to be used for professional-use purposes; in particular, the apparatus has started to be put into full-fledged use in light printing applications (print-on-demand (POD) applications where a large number of kinds can be printed in small amounts each).

When it is assumed that an electrostatic latent image bearing member is used in a light printing application where high reliability and high durability are requested, an improvement in durability of the electrostatic latent image bearing member requires an increase in surface hardness of the member.

However, when the durability of the electrostatic latent image bearing member is improved as described above so that the electrostatic latent image bearing member can be used in a POD application, the surface of the electrostatic latent image bearing member is hardly shaved and hardly refreshed, so the improvement is disadvantageous for the prevention of image smearing.

In view of the foregoing, the following procedure has been conventionally adopted: a heater for temperature regulation (hereinafter referred to as "drum heater") is provided for the inside of the electrostatic latent image bearing member so that the problem known as "image smearing" is dissolved. However, it has been demanded to perform the removal of the drum heater for energy-saving purposes because the drum heater requires electrification and consumes power even at nighttime during which the drum heater is not used.

In addition, even when such a constitution that corona products on the electrostatic latent image bearing member are removed with an air blow or the like is established, an increase in amount of the corona products to be produced precludes sufficient removal of the products, so it may become impossible to inhibit the occurrence of an image defect with reliability. The frequency at which corona products are produced increases particularly in a high-speed developing system to be used in a POD application, so image smearing is apt to be induced in the system.

To cope with the image smearing, the following approach on a toner side has been conventionally adopted (Japanese Patent Application Laid-Open No. Hei 5-273785): an inorganic fine powder is added to toner, and the image smearing is prevented by the abrasive action of the powder. However, when the approach is employed in the above-mentioned POD application, an electrostatic latent image bearing member is hardly abraded, with the result that corona products cannot be sufficiently removed. In addition, when fine particles each of which can serve as a spacer are added to the toner, a phenomenon in which the spacer particles are liberated occurs, so image defects due to the contamination of the inside of the apparatus and insufficient charging of the member are prompted in some cases.

In view of the foregoing, the following attempt has been proposed: corona products are removed by utilizing a substituting ability which a laminar compound and a porous material each have instead of the abrasive action. For example, Japanese Patent Application Laid-Open No. 2003-066637 proposes a method involving feeding a compound having an acid-receiving effect such as a hydrotalcite compound. The hydrotalcite compound is a laminar compound composed of a positively charged layer and a negatively charged layer. The compound reduces influences of the corona products by the following action: $CO_3^{2-}$ in the structure of the compound is ion exchangeable, so $CO_3^{2-}$ adsorbs an acid by easily substituting with any other anion. However, it is hard to say that the compound has a sufficient adsorbing ability because the sites where the ions can substitute are mainly the edge portions of the respective layers.

In view of the foregoing, it has been proposed that zeolite or the like be used as a polar adsorbent (Japanese Patent Application Laid-Open No. 2003-91223). A porous material such as zeolite has a larger number of substitution sites and a higher substituting ability than those of a compound of a laminar structure. However, zeolite as a porous material has a pore diameter as small as about 1.5 nm, and a wall between a pore and an adjacent pore is thin, so zeolite has a low physical strength as a porous material. Since toner is stirred at a high speed particularly in a developing device to be used in a POD application, the following detrimental effect arises: the shapes of porous external additive particles are broken by a sliding action between the particles, and the broken external additive particles affect the parent body of the toner.

It has been proposed that a porous powder impregnated with silicone oil be used as a porous material excellent in stability against a mechanical stress (Japanese Patent Application Laid-Open No. Hei 2-221964). However, the powder is impregnated with silicone oil so that the pores of the powder are filled. As a result, there is a possibility that the pores cannot sufficiently exert their substituting abilities, and corona products cannot be sufficiently removed. In addition, the particles of the powder each have a large particle diameter; specifically, the particles each have a primary particle diameter of from 2 μm or more and to 15 μm or less. As a result, the powder serves as a liberated external additive particularly in a high-speed developing system to be used in a POD application, and the scattering of the powder may lead to the contamination of the inside of the system, or may cause the destabilization of the charging of the system.

Further, it has been proposed that the developing performance of toner be improved by adding a calcium phosphate compound having a porous structure (Japanese Patent Application Laid-Open No. 2002-287414). However, the compound used has a large pore diameter, and cannot sufficiently capture corona products, so the proposal is not a sufficient measure against image smearing.

As described above, at present, no toner capable of achieving compatibility between the removal of a corona product and a combination of high durability and high stability in a high-speed developing system for a POD application using no drum heater is still available.

SUMMARY OF THE INVENTION

An object of the present invention is to provide a toner which has dissolved the above problems.

Another object of the present invention is to provide a toner capable of providing stable image quality without causing any image defect even when the toner is used over a long time period in a high-speed developing system.

The objects of the present invention are accomplished by the following: that is, a toner including: toner particles each containing at least a binder resin and a colorant; and an inorganic fine powder, in which the inorganic fine powder has a ratio (A/B) of a total pore volume A measured in a pore diameter range of from 1.9 nm or more and to 8.0 nm or less to a total pore volume B measured in a pore diameter range of from 1.9 nm or more and to 300.0 nm or less of from 0.20 or more and to 1.00 or less, and the total pore volume A is from $1.00\times10^{-2}$ $cm^3/g$ or more and to 1.00 $cm^3/g$ or less.

According to a preferred embodiment of the present invention, there can be provided a toner capable of showing the following characteristics in a high-speed developing system for a long time period: the toner prevents the occurrence of image defects such as image smearing, is excellent in charging stability, does not deteriorate, and provides a stable image density.

DETAILED DESCRIPTION OF THE PREFERRED EMBODIMENTS

The inventors of the present invention have found that controlling the pore distribution and pore volumes of an inorganic fine powder can provide a toner capable of showing the following characteristics even in a high-speed developing system for a long time period: the toner prevents the occurrence of image defects such as image smearing, does not deteriorate, and provides a stable image density.

That is, the toner of the present invention includes: toner particles each containing at least a binder resin and a colorant; and an inorganic fine powder, in which the inorganic fine powder has a ratio (A/B) of a total pore volume A measured in a pore diameter range of from 1.9 nm or more and to 8.0 nm or less to a total pore volume B measured in a pore diameter range of from 1.9 nm or more and to 300.0 nm or less of from 0.20 or more and to 1.00 or less, and the total pore volume A is from $1.00\times10^{-2}$ $cm^3/g$ or more and to 1.00 $cm^3/g$ or less.

The following means has been conventionally adopted: an inorganic fine powder is added to toner, and image smearing is prevented by the abrasive action of the powder. However, when the means is employed in the above-mentioned POD application, an electrostatic latent image bearing member has a high surface hardness, so the abrasive action of the inorganic fine powder cannot be sufficiently exerted, and corona products cannot be sufficiently removed. As a result, for example, an image defect such as image smearing, or a reduction in durable density due to nonuniform charging of the member occurs.

In addition, a material as an adsorbent has been unable to exert its ability sufficiently in a POD application. In other words, an adsorbent merely having a laminar structure or porous structure does not suffice for a high-speed developing system for a POD application, so the control of the surface fine structure and, eventually, surface properties of the adsorbent like the present invention is of importance.

In view of the foregoing, the inventors of the present invention have made extensive studies on the surface pore state of an inorganic fine powder. As a result, the inventors have found that a toner capable of solving the above problems can be obtained by adding an inorganic fine powder having a specific pore state to the particles of the toner.

That is, the inorganic fine powder used in the present invention has a ratio (A/B) of a total pore volume A measured in a pore diameter range of from 1.9 nm or more and to 8.0 nm or less to a total pore volume B measured in a pore diameter range of from 1.9 nm or more and to 300.0 nm or less of from 0.20 or more and to 1.00 or less, preferably from 0.60 or more and to 1.00 or less, or more preferably from 0.80 or more and to 1.00 or less.

A state where the above ratio (A/B) of the total pore volume A to the total pore volume B is close to 1.00 means that most of the pores of the inorganic fine powder each have a pore diameter of from 1.9 nm or more and to 8.0 nm or less, and the pore distribution of the inorganic fine powder is sharp.

When the inorganic fine powder has pores each having a pore diameter in a specific range, and has a sharp pore distribution as described above, the powder can selectively capture only corona products, and hence a toner causing none of the image defects such as image smearing can be provided.

In addition, when triboelectric charging is performed between the particles of the toner, porous particles on the surface of the toner contact with each other mainly at their protruded portions, so a charge difference arises between a depressed portion and a protruded portion in each porous particle. A charge distribution as a result of the difference largely contributes to the charging stability of the toner because the distribution serves to suppress excessive charge-up of the toner and to aid the charging of the toner at the time of a reduction in charge quantity of the toner; the distribution exerts a significant effect particularly in a developing system for a POD application where long-term durable stability is requested of the toner. Therefore, when the pore diameters of porous particles are uniform like the inorganic fine powder to be used in the present invention, the charge quantities of the porous particles are uniformized, and the uniformization contributes to the charging stability of the toner.

A state where the above ratio (A/B) of the total pore volume A to the total pore volume B is less than 0.20 means that the ratio of pores each having a pore diameter of from 1.9 nm or more and to 8.0 nm or less is extremely small. As a result, the inorganic fine powder has pores each having so large a pore diameter that the powder cannot capture corona products, or any other material such as silica enters each of the pores at the time of the production of the toner so that an adsorbing effect of the inorganic fine powder on the corona products reduces. In addition, the ratio of the protruded portions of the inorganic fine powder becomes relatively small, so the charging balance of the toner is lost, and the durable density stability of the toner reduces.

It should be noted that the above ratio of the total pore volume A to the total pore volume B can be controlled to fall within the above range by adjusting a pH and managing, for example, a washing method and a reaction temperature during production steps for the inorganic fine powder.

In addition, the total pore volume A of the inorganic fine powder to be used in the present invention is from $1.00\times10^{-2}$ $cm^3/g$ or more and to 1.00 $cm^3/g$ or less, preferably from $2.00\times10^{-2}$ $cm^3/g$ or more and to 1.00 $cm^3/g$ or less, or more preferably from $5.00\times10^{-2}$ $cm^3/g$ or more and to $8.00\times10^{-1}$ $cm^3/g$ or less.

The above total pore volume A represents the ability of the inorganic fine powder to capture corona products. Therefore, when the total pore volume A is less than $1.00\times10^{-2}$ $cm^3/g$, the inorganic fine powder has so small a pore volume as to be capable of capturing only part of the corona products; in particular, in a high-speed developing system to be used in a POD application, the frequency at which corona products are produced increases, so the inorganic fine powder cannot capture a sufficient amount of the corona products, and image smearing is apt to occur. On the other hand, when the total pore volume A is larger than 1.00 $cm^3/g$, the pores of the inorganic fine powder are deep, or the number of the pores is excessively large, so the inorganic fine powder becomes weak against a mechanical shear. As a result, the inorganic fine powder is broken by, for example, stirring in a developing device in a high-speed developing system, and the broken powder is embedded in the toner. The embedment leads to the deterioration of the toner, so the durable density stability of the toner reduces. It should be noted that the above total pore volume A can be controlled to fall within the above range by adjusting a pH and managing, for example, a washing method during production steps for the inorganic fine powder.

The total pore volume of the inorganic fine powder in the present invention is measured with a pore distribution measuring apparatus Tristar 3000 (manufactured by Shimadzu Corporation) by a gas adsorption method involving causing a nitrogen gas to adsorb to the surface of a sample. The outline of the measurement is described in an operation manual issued by Shimadzu Corporation, and is as described below.

About 2 g of a sample are loaded into a test tube, and the test tube is evacuated to a vacuum at 100° C. for 24 hours prior to the measurement of the pore distribution of the sample. After the completion of the evacuation, the weight of the sample is precisely measured, whereby a sample is obtained. The total pore volume of the resultant sample in the pore diameter range of from 1.7 nm or more and to 300.0 in or less is determined with the above pore distribution measuring apparatus by a BJH desorption method. The total pore volume closest to measurement data information is preferably used as an indication in evaluation for pore distribution.

In addition, the inorganic fine powder to be used in the present invention has a specific surface area (BET value) of preferably from 10.0 $m^2/g$ or more and to 400.0 $m^2/g$ or less, more preferably from 50.0 $m^2/g$ or more and to 400.0 $m^2/g$ or less, or still more preferably from 150.0 $m^2/g$ or more and to 350.0 $m^2/g$ or less.

As long as the above specific surface area (BET value) falls within the above range, the inorganic fine powder can capture corona products in an additionally sufficient fashion, and the charging balance of the toner becomes favorable, so the toner can obtain an additionally stable charge quantity even under a high-temperature, high-humidity environment or low-temperature, low-humidity environment. Further, the amount of the pores of the inorganic fine powder is moderate, so the inorganic fine powder can obtain a sufficient physical strength, and is hardly broken even when the powder receives a stress due to, for example, stirring in a developing device in a high-speed developing system, and the deterioration of the toner hardly occurs.

It should be noted that the above specific surface area (BET value) can be adjusted to fall within the above range by controlling, for example, a reaction temperature, a stirring speed at the time of the reaction, and a drying temperature at the time of the production of the inorganic fine powder.

The above specific surface area (BET value) was calculated with a specific surface area measuring apparatus GEMINI 2375 (Shimadzu Corporation) by employing a BET specific surface area multipoint method while causing a nitrogen gas to adsorb to the surface of the sample in accordance with a BET specific surface area method.

Any inorganic fine powder can be used as the inorganic fine powder to be used in the present invention as long as the inorganic fine powder has the above properties; the inorganic fine powder to be used preferably further has the following property.

The inorganic fine powder to be used in the present invention has a median diameter on a volume basis (which may hereinafter be referred to as "D50") of preferably from 0.50 μm or more and to 5.00 μm or less, or more preferably from 0.80 μm or more and to 3.00 μm or less.

When the D50 of the above inorganic fine powder is controlled to fall within the above range, the deterioration of the toner due to, for example, the embedment of the inorganic fine powder hardly occurs even in an environment where the toner receives a large shear in a developing device like an additionally high-speed developing system. In addition, the liberation of the inorganic fine powder from the toner can be suppressed to a moderate level, so a stable durable density tends to be obtained over a long time period.

The above D50 can be adjusted to fall within the above range by controlling, for example, a reaction temperature, a stirring speed at the time of the reaction, and a drying temperature at the time of the production of the inorganic fine powder.

The above D50 is measured with a laser diffraction/scattering particle size distribution measuring apparatus LA-920 (manufactured by HORIBA, Ltd.). A method for the measurement is as described below. About 30 mg of the inorganic fine powder sample are loaded into 100 ml of ion-exchanaged water as a dispersion medium, and the dispersion liquid is treated with an ultrasonic dispersing machine for 1 minute, whereby a dispersion liquid is obtained. The dispersion liquid is dropped to a measurement cell so that the concentration of the sample may be such that the transmittance of the liquid is around 80%. A relative index of refraction between the inorganic fine powder and water is set in accordance with the kind of the inorganic fine powder, and the particle size distribution of the inorganic fine powder on a volume basis is measured with the measuring apparatus so that the median diameter (D50) is determined.

A material to be used for the formation of the above inorganic fine powder is not particularly limited as long as the ratio (A/B) of the total pore volume A to the total pore volume B, and the total pore volume A can be set at desired values. To be specific, an inorganic material such as silica, titanium oxide, alumina, cerium oxide, or strontium titanate, or a crystalline substance such as an alunite type compound (compound having an alunite type crystal such as alunite ($KAl_3(SO_4)_2(OH)_6$), natroalunite ($NaAl_3(SO_4)_2(OH)_6$, or natrojarosite ($NaFe_3(SO_4)_2(OH)_5$)) can be used.

The above inorganic fine powder is particularly preferably an alunite type compound because uniform pores can be easily obtained. In addition, the alunite type compound contains a metal portion made of, for example, sodium, aluminum, or potassium which can be positively charged with ease and a salt such as a sulfate or hydroxyl salt which can be negatively charged with ease, so a charging balance in the toner can be additionally improved, and the toner can obtain additional durable stability. Any one of the various methods such as a coprecipitation method, an ion exchange method, and an impregnation method can be utilized as a method of producing the alunite type compound; the coprecipitation method is preferable from the viewpoint of production stability.

An alunite type adsorbent having the above desired pore distribution of the present application can be obtained by the following approaches in production steps for the above alunite type compound: the optimization of a stirring speed, the maintenance of a pH in a system at a constant value, and the optimization of a condition for washing.

That is, an alunite type compound having a large pore volume and a sharp pore distribution can be obtained by maintaining the pH in the system at a constant value of from 3.8 or more and to 4.4 or less throughout the entire period of a reaction in the production steps. In addition, when the compound is washed with water at about 40° C. several times, even the insides of the pores can be washed, whereby a large pore volume can be obtained.

In addition, a drying step is preferably performed at from 90° C. or higher and to 150° C. or lower for a drying time of from 6 hours or more and to 36 hours or less in order that a desired pore distribution and a desired pore volume may be obtained.

In addition, an inorganic fine powder except the above alunite type compound is preferably produced by utilizing the sol-gel reaction of a desired component such as silicon or titanium with the micelle structure of a surfactant as a template. When the production method is not employed, ultrafine particles agglomerate, so the physical strength of a structure which adsorbs a substance by means of gaps between fine particles such as silica gel may reduce. When the physical strength reduces, the shapes of porous particles are broken by a sliding action between the particles at the time of the stirring of the toner in a developing device, with the result that the following detrimental effect may arise: the particle diameters of the particles change, or the broken particles affect the parent body of the toner.

The above inorganic fine powder may be subjected to a hydrophobic treatment. In the hydrophobic treatment, one kind of treatment agents such as a silicone varnish, various modified silicone varnishes, a silicone oil, various modified silicone oils, a silane compound, a silane coupling agent, any other organic silicon compound, and an organic titanium compound may be used alone, or two or more kinds of them may be used in combination.

The content of the inorganic fine powder having the above properties to be used in the toner of the present invention is preferably from 0.05 part by mass or more and to 2.00 parts by mass or less, or more preferably from 0.10 part by mass or more and to 0.80 part by mass or less with respect to 100 parts by mass of the toner particles. When the content of the inorganic fine powder having the above properties falls within the above range, the addition amount of the inorganic fine powder to the toner particles is moderate, so a sufficient effect of the addition can be obtained. Moreover, the charging balance of the toner can be kept at a particularly favorable level.

In addition, the inorganic fine powder is preferably externally added to the toner particles. A known method can be employed as a method of externally adding the inorganic fine powder to the toner particles.

As the binder resin that can be used for the toner of the present invention, there are given, for example: polystyrene; monopolymers of styrene substituents such as poly-p-chlorstyrene and polyvinyltoluene; styrene copolymers such as a styrene-p-chlorstyrene copolymer, a styrene-vinyltoluene copolymer, a styrene-vinylnaphthaline copolymer, a styrene-acrylate copolymer, a styrene-methacrylate copolymer, a styrene-α-chlormethyl methacrylate copolymer, a styrene-acrylonitrile copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, and a styrene-acrylonitrile-indene copolymer; polyvinyl chloride; a phenol resin; a natural modified phenol resin; a natural resin modified maleic resin; an acrylic resin; a methacrylic resin; a polyvinyl acetate; a silicone resin; a polyester resin; polyurethane; a polyamide resin; a furan resin; an epoxy resin; a xylene resin; a polyvinyl butyral; a terpene resin; a coumarone-indene resin; and a petroleum resin.

Of those described above, a binder resin containing a polyester resin is particularly preferably used because of the following reason: an affinity between a carboxyl group or hydroxyl group on the surface of each toner particle and a positively charged group or negatively charged group of the inorganic fine powder improves, so the inorganic fine powder can be uniformly dispersed in the surface of each toner particle. Further, the binder resin more preferably contains: a mixed resin of a polyester resin and a vinyl resin; or a hybrid resin component obtained as a result of a reaction between parts of both the resins. When such resin is used, the inorganic fine powder is dispersed in the surface of each toner particle in an additionally uniform fashion by virtue of an influence of a carboxyl group or hydroxyl group at a terminal of polyester present on the surface of each toner particle. As a result, the rise-up of charging of the toner is quick, and a stable image density can be obtained over a long time period.

A polyester monomer of which the polyester unit in the above polyester resin or in the above hybrid resin to be used for the binder resin is constituted is, for example, any one of the following compounds.

Examples of alcohol components include the following: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (I-1), and diols represented by the following formula (I-2).

Formula (I-1)

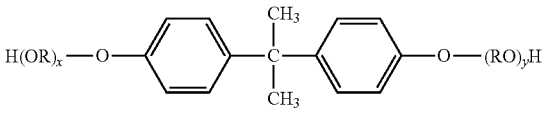

(where R represents an ethylene group or a propylene group, x and y represent an integer of 1 or more, respectively, and an average value of x and y is 2 to 10.)

Formula (I-2)

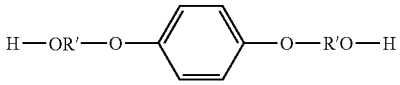

(where R' represents —$CH_2CH_2$—, —$CH_2$—$CH(CH_3)$—, or —$CH_2$—$C(CH_3)_2$—.)

Examples of carboxylic acid components include the following: benzenedicarboxylic acids such as phthalic acid, terephthalic acid, isophthlic acid, and phthalic anhydride, or anhydrides thereof; alkyldicarboxylic acids such as succinic acid, adipic acid, sebacic acid, and azelaic acid, or anhydrides thereof; succinic acids substituted with an alkyl group or an alkenyl group having carbon atoms of from 6 or more and to 18 or less, or anhydrides thereof; and unsaturated dicarboxylic acids such as fumaric acid, maleic acid, citraconic acid, and itaconic acid, or anhydrides thereof.

In addition, the above polyester resin or the above polyester unit of the hybrid resin preferably contains a polyester resin having a crosslinked structure based on a polyvalent carboxylic acid which is trivalent or more or an anhydride of the acid and/or a polyhydric alcohol which is trihydric or more.

Examples of the polyvalent carboxylic acid which is trivalent or more or the anhydride of the acid include 1,2,4-benzenetricarboxylic acid, 1,2,4-cyclohexanetricarboxylic acid, 1,2,4-naphthalenetricarboxylic acid, and pyromellitic acid, and anhydrides or lower alkyl esters of these acids.

Examples of the polyhydric alcohol which is trihydric or more include 1,2,3-propanetriol, trimethylolpropane, hexanetriol, and pencaerythritol. Of those, aromatic alcohols components such as 1,2,4-benzenetricarboxylic acid and an anhydride of the acid are particularly preferable because each of them shows high stability due to environmental fluctuation.

A vinyl monomer of which the above vinyl resin or the above vinyl polymer unit of the hybrid resin to be used for the binder resin is constituted is, for example, any one of the following compounds.

Examples include: styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butylacrylate, isobutylacrylate, propylacrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylale or methacrylate derivatives such as acrylonitrile, methacrylonitrile, and acrylamide.

The examples further include: unsaturated dibasic acids such as maleic acid, citraconic acid, itaconic acid, an alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and anhydrides and monoesters of these acids.

The examples further include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

The vinyl resin or the vinyl polymer unit of the hybrid resin to be used for the binder resin in the present invention may have a crosslinked structure in which its molecules are crosslinked with a crosslinking agent having two or more vinyl groups. Examples of the crosslinking agent to be used in the case include: aromatic divinyl compounds (such as divinylbenzene and divinylnaphthalene); diacrylate compounds bonded with an alkyl chain (such as ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and those obtained by replacing the "acrylate" of each of the compounds with "methacrylate"); diacrylate compounds bonded with an alkyl chain containing an ether bond (such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by replacing the "acrylate" of each of the compounds with "methacrylate"); diacrylate compounds bonded with a chain containing an aromatic group and an ether bond (such as polyoxyethylene (2)-2,2-bis (4-hydroxyphenyl)propane diacrylate, polyoxyethylene(4)-2,2-bis(4-hydroxyphenyl)propane diacrylate, and those obtained by replacing the "acrylate" of each of the compounds with "methacrylate"); and polyester-type diacrylate compounds (for example, tradename "MANDA", available from Nippon Kayaku Co., Ltd.)

Examples of polyfunctional crosslinking agents include the following: pentaerythritol triacrylate, trimethylolethane triacrylate, trimethylolpropane triacrylate, tetramethylolmethane tetraacrylate, oligoesteracrylate, and those obtained by replacing the "acrylate" of each of the compounds with "methacrylate"; and triallyl cyanurate and triallyl trimellitate.

Of those crosslinking agents, for example, the aromatic divinyl compounds (especially divinylbenzene) and the diacrylate compounds each composed of two acrylates bonded to each other through a chain containing an aromatic group and an ether bond are each suitably used in the binder resin in terms of the fixing performance and offset resistance of the toner.

These crosslinking agents can be used in an amount of preferably from 0.01 part by mass or more and to 10.00 parts by mass or less, more preferably from 0.03 part by mass or more and to 5.00 parts by mass or less with respect to 100 parts by mass of vinyl monomer components.

Examples of polymerization initiators used for polymerizing the above vinyl resin or vinyl polymer resin unit of a hybrid resin include the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides such as methyl ethyl ketone peroxide, acetylacetone peroxide, and cyclohexanone peroxide; and 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butylperoxyisopropyl carbonate, di-tert-butyl peroxyisophthalate, tert-butyl peroxyallylcarbonate, tert-amyl peroxy-2-ethylhexanoate, di-tert-butyl peroxyhexahydroterephthalate, and di-tert-butyl peroxyazelate.

When the hybrid resin is used as the binder resin, the vinyl resin and/or the polyester resin component each preferably contain/preferably contains a monomer component that can react with both the resin components. A monomer of which the polyester resin component is constituted and which can react with the vinyl resin is, for example, an unsaturated dicarboxylic acid such as phthalic acid, maleic acid, citraconic acid, or itaconic acid, or an anhydride of the acid. A monomer of which the vinyl resin component is constituted and which can react with the polyester resin component is, for example, a unit having a carboxyl group or a hydroxy group, or any one of the acrylates and methacrylates.

The hybrid resin of a reaction between the vinyl resin and the polyester resin is preferably obtained by the following method: one, or both, of the vinyl resin and the polyester resin is, or are each, subjected to a polymerization reaction in the presence of a polymer containing any such monomer component that can react with each of the resins as exemplified above. In the hybrid resin, a mass ratio between the polyester monomer and the vinyl monomer is preferably 50:50 to 90:10, or more preferably 60:40 to 85:15. When the mass ratio of the polyester monomer is less than 50%, the toner easily loses the charging property. On the other hand, when the mass ratio of the polyester monomer is more than 90%, not only the balance of the charging property easily breaks, but also adverse effects may be given on the storage stability of the toner and the dispersing state of a release agent.

The above binder resin preferably has a peak molecular weight (Mp) of from 5,000 or more and to 20,000 or less, a weight average molecular weight (Mw) of from 5,000 or more and to 300,000 or less, and a ratio (Mw/Mn) of the weight average molecular weight (Mw) to the number average molecular weight (Mn) of from 5 or more and to 50 or less in the molecular weight distribution of the tetrahydrofuran (THF) soluble matter of the binder resin measured by gel permeation chromatography (GPC). When the Mp and the Mw are small and the distribution is sharp, hot offset tends to occur. In addition, when the Mp and the Mw are large and the distribution is broad, the low-temperature fixability of the toner tends to reduce.

In addition, the above binder resin has a glass transition temperature of preferably from 53° C. or higher and to 62° C. or lower from the viewpoints of the fixing performance and storage stability of the toner.

In the present invention, the content of the tetrahydrofuran (THF) insoluble matter obtained by extracting the binder resin of which each of the toner particles is constituted with THF for 16 hours is preferably from 15 mass % or more and to 50 mass % or less, or more, preferably from 15 mass % or more and to 45 mass % or less.

When the content of the THF insoluble matter of the above binder resin satisfies the above range, the toner shows good releasing performance against a heating member such as a fixing roller, so the amount of the offset of the toner to the heating member such as a fixing roller reduces even in the case where the toner is applied to a high-speed machine. In addition, as long as the content falls within the above range, any other component such as the colorant is also favorably dispersed, whereby the charging performance of the toner becomes additionally favorable.

The above binder resin may be formed by using only one kind of a resin; in the present invention, a mixture of two kinds of resins different from each other in softening point, i.e., a high-softening-point resin (a) and a low-softening-point resin (b) at a ratio in the range of 90:10 to 10:90 may be used. The system is preferable because the molecular weight distribution of the toner can be designed with relative ease and the toner can be provided with a wide fixing region.

A release agent can be used in the present invention as required in order that releasing performance may be imparted to the toner. Preferable examples of the release agent include: hydrocarbon waxes such as low-molecular weight polyethylene, low-molecular weight polypropylene, a microcrystalline wax, and a paraffin wax due to easiness of dispersion in the particles of the toner and high releasing performance. One or two or more kinds of release agents in a little amount may be used where necessary. Specific examples include the following.

Examples of the release agent used in combination include: oxides of aliphatic hydrocarbon waxes such as a polyethylene oxide wax and block copolymers thereof; waxes mainly composed of fatty acid esters such as a carnauba wax, a sasol wax, and a montanic acid ester wax; and partially or wholly deacidified fatty acid esters such as a deacidified carnauba wax. Further examples include: straight-chain saturated fatty acids such as palmitic acid, stearic acid, and montanic acid; unsaturated fatty acid esters such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; alkyl alcohols having a long-chain; polyhydric alcohols such as sorbitol; fatty acid amides such as linoleic amide, oleic amide, and lauric amide; saturated fatty acid bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N-dioleyl sebacamide; aromatic bis amides such as m-xylene bis stearamide and N,N-distearyl isophthalamnide; fatty acid metal salts (what are generally referred to as metallic soaps) such as calcium stearate, calcium laurate, zinc stearate, and magnesium stearate; graft waxes of which aliphatic hydrocarbon waxes are grafted with vinyl monomers such as styrene and acrylic acid; partially esterified compounds of fatty acids and polyhydric alcohols such as behenic monoglyceride; and methyl ester compounds having hydroxyl groups obtained by hydrogenation of vegetable oil.

Examples of a release agent to be particularly preferably used in the present invention include aliphatic hydrocarbon waxes. The examples of such aliphatic hydrocarbon waxes include the following: a low-molecular weight alkylene polymer obtained by subjecting an alkylene to radical polymerization under high pressure or by polymerizing an alkylene under reduced pressure by using a Ziegler catalyst; an alkylene polymer obtained by thermal decomposition of a high-molecular weight alkylene polymer; a synthetic hydrocarbon wax obtained from a residue on distillation of a hydrocarbon obtained by means of an Age method from a synthetic gas containing carbon monoxide and hydrogen, and a synthetic hydrocarbon wax obtained by hydrogenation of the wax; and those obtained by fractionating those aliphatic hydrocarbon waxes by means of a press sweating method, a solvent method, or vacuum distillation or according to a fractional crystallization mode.

A hydrocarbon as a parent body for the above aliphatic hydrocarbon wax is, for example, a hydrocarbon synthesized by a reaction between carbon monoxide and hydrogen using a metal oxide catalyst (a multiple system composed of two or more kinds in many cases) (such as a hydrocarbon compound synthesized by a synthol method or a hydrocol method (involving the use of a fluid catalyst bed)), a hydrocarbon having up to several hundreds of carbon atoms obtained by an Age method (involving the use of an identification catalyst bed) with which a large amount of a wax-like hydrocarbon can be obtained, or a hydrocarbon obtained by polymerizing an alkylene such as ethylene with a Ziegler catalyst. Of such hydrocarbons, in the present invention, a saturated, long linear hydrocarbon with a small number of small branches is preferable; a hydrocarbon synthesized by a method not involving the polymerization of an alkylene is particularly preferable because of its molecular weight distribution.

Specific examples of a release agent include the following: Biscol (registered trademark) 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol Co.); HNP-1, HNP-3, HNP-9, HNP-10, HNP-11, and HNP-12 (NIPPON SETRO CO., LTD); Unilin (registered trademark) 350, 425, 550, and 700, Unisid (registered trademark) 350, 425, 550, and 700 (TOYO-PETROLITE); and a haze wax, a beeswax, a rice wax, a candelilla wax, and a carnauba wax (available from CERARICA NODA Co., Ltd.).

The time at which the release agent is added may be the melt kneading step upon production of toner particles or in the production of the binder resin, and appropriately selected from conventional methods.

The release agent is preferably added in an amount of from 1.0 part by mass or more and to 20.0 parts by mass or less with respect to 100 parts by mass of the binder resin. When the addition amount is less than 1.0 part by mass, a desired releasing effect is not sufficiently obtained. On the other hand, when the addition amount is more than 20.0 parts by mass, the dispersing performance of the release agent in the toner tends to lower, and hence the adhesion of the toner to a photosensitive member and the contamination of the surface of a developing member or cleaning member tend to occur, with the result that a toner image tends to deteriorate.

The toner of the present invention may be a magnetic toner or a non-magnetic toner.

In the case of the magnetic toner, examples of the magnetic material to be used include: magnetic iron oxides containing iron oxides such as magnetite, maghemite, and ferrite and other metal oxides; metals such as Fe, Co, and Ni, or alloys thereof with metals such as Al, Co, Pb, Mg, Ni, Sn, Zr, Sb, Be, Bf, Cd, Ca, Mn, Se, Ti, W, and V; and mixtures thereof. Conventionally, triiron tetraoxide ($Fe_3O_4$), γ-iron sesquioxide ($\gamma$-$Fe_2O_3$), zinc iron oxide ($ZrFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like have been known. Particularly preferable magnetic material is fine powder of triion tetraoxide or γ-iron sesquioxide. Further, each of the magnetic materials mentioned above can be selected and used alone, or two or more kinds thereof can be selected and used in combination.

Each of those magnetic materials preferably has magnetic properties in an applied magnetic field of 795.8 kA/m including: a coercive force Hc of from 1.6 KA/m or more and to 12.0 kA/m or less; a saturation magnetization σs of from 50 $Am^2$/kg or more and to 200 $Am^2$/kg or less (more preferably from 50 $Am^2$/kg or more and to 100 $Am^2$/kg or less); and a residual magnetization or of from 2 $Am^2$/kg or more and to 20 $Am^2$/kg or less. The magnetic properties of the magnetic material in an external magnetic field of 795.8 kA/m at 25° C. can be measured by using an oscillation sample type magnetometer such as a VSM P-1-10 (manufactured by Toei Industry Co., Ltd.).

The amount of the magnetic material to be added is preferably 10.0 to 200.0 parts by mass with respect to 100 parts by mass of the binder resin.

In addition, carbon black or at least one kind of the other conventionally known various pigments and dyes can be used as the colorant to be contained in the toner of the present invention.

Examples of the dye include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Example of the pigment include Chrome Yellow, Cadmium Yellow, Mineral Fast Yellow, Navel Yellow, Naphthol Yellow S, Hansa Yellow G, Permanent Yellow NCG, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Purple, Fast Violet B, Methyl Violet Lake, Prussian Blue, Cobalt Blue, Alkali Blue Lake, Victoria Blue Lake, Phthalocyanine Blue, Fast Sky Blue, Indanthrene Blue BC, Chrome Green, Chrome Oxide, Pigment Green B, Malachite Green Lake, and Final Yellow Green G.

When the toner of the present invention is used for full color image-forming toner, the following colorants can be used.

Examples of coloring pigments for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet 19; and C.I. Vat Red 1, 2, 10, 13, 15, 23, 29, and 35.

Each of the coloring pigments for magenta may be used alone. However, it is more preferable to combine the dye and the pigment to improve definition of an image, from the viewpoint of image quality of a full color image. Examples of the coloring pigment for magenta include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Examples of the coloring pigment for cyan include: C.I. Pigment Blue 2, 3, 15, 16, and 17; C.I. Vat Blue 6; C.I. Acid Blue 45; and a copper phthalocyanine pigment in which a phthalocyanine skeleton having the following structure is substituted by 1 to 5 phthalimidemethyl groups.

[Chem 2]

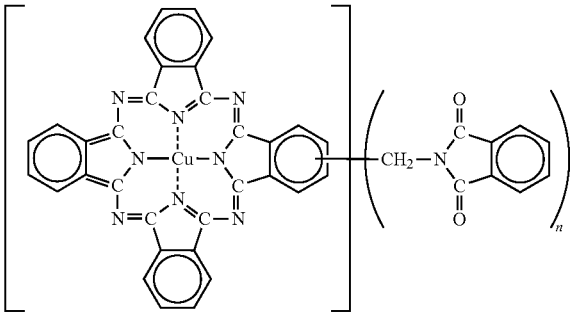

n = 1 ~ 5

Examples of the coloring pigment for yellow include: C.I. Pigment Yellow 1, 2, 3, 4, 5, 6, 7, 10, 11, 12, 13, 14, 15, 16, 17, 23, 35, 73, and 83; and C.I. Vat yellow 1, 3, and 20.

The content of the colorant is preferably from 0.1 part by mass or more and to 60 parts by mass or less, or more preferably from 0.5 part by mass or more and to 50 parts by mass or less with respect to 100 parts by mass of the binder resin.

A charge control agent can be used in the toner of the present invention to stabilize the charging property of the toner. A charge control agent is generally incorporated into toner particles in an amount of preferably from 0.1 part by mass or more and to 10 parts by mass or less, or more preferably from 0.1 part by mass or more and to 5 parts by mass or less with respect to 100 parts by mass of the binder resin, although the amount varies depending on, for example, the kind of the charge control agent and the physical properties of other materials constituting the toner particles.

Known examples of the charge control agent include one for controlling toner to be negatively chargeable and one for controlling toner to be positively chargeable. One kind of various charge control agents or two or more kinds of them can be used depending on the kind and applications of the toner.

For example, an organometallic complex or a chelate compound is an effective charge control agent for controlling toner to be negatively chargeable. Examples of such charge control agent for controlling toner to be negatively chargeable include: monoazo metal complexes; acetylacetone metal complexes; metal complexes or metal salts of aromatic hydroxycarboxylic acids or aromatic dicarboxylic acids. The examples of such charge control agent for controlling toner to be negatively chargeable further include: aromatic monocarboxylic and polycarboxylic acids, and metal salts and anhydrates of the acids; esters; and phenol derivatives such as bisphenol. Of those, a metal complex or metal salt of an aromatic hydroxycarboxylic acid capable of providing stable charging performance is particularly preferably used.

In addition, in the present invention, negatively chargeable toner particles are preferably used, so a negative charge control agent or negative charge control resin is preferably used.

Examples of a charge control agent for controlling toner to be positively chargeable include: nigrosin and modified products of nigrosin with aliphatic metal salts, and the like; quaternary ammonium salts such as tributylbenzyl ammonium-1-hydroxy-4-naphthosulfonate and tetrabutyl ammonium tetrafluoroborate, and analogs of the salts, which are onium salts such as phosphonium salts and lake pigments of the salts; triphenyl methane dyes and lake pigments of the dyes (lake agents include phosphotungstic acid, phosphomolybdic acid, phosphotungsten molybdic acid, tannic acid, lauric acid, gallic acid, ferricyanic acid, and ferrocyanide); metal salts of higher aliphatic acids; diorganotin oxides such as dibutyltin oxide, dioctyltin oxide, and dicyclohexyltin oxide; and diorganotin borates such as dibutyltin borate, dioctyltin borate, and dicyclohexyltin borate. In the present invention, one kind of them may be used alone, or two or more kinds of them may be used in combination. Of those, a charge control agent for controlling toner to be positively chargeable made of a nigrosin compound, a quaternary ammonium salt, or the like is particularly preferably used.

Specific examples of a charge control agent for controlling toner to be negatively chargeable that can be used include: Spilon Black TRH, T-77, and T-95 (Hodogaya Chemical Co., Ltd.); and BONTRON (registered trademark) S-34, S-44, S-54, E-84, E-88, and E-89 (Orient Chemical Industries, LTD.). Preferable examples of a charge control agent for controlling toner to be positively chargeable include: TP-302 and TP-415 (Hodogaya Chemical Co., Ltd.); BONTRON (registered trademark) N-01, N-04, N-07, and P-51 (Orient Chemical Industries, LTD.); and Copy Blue PR (Clariant).

A charge control resin can also be used, and can be used in combination with any one of the above-mentioned charge control agents.

The charging property of the toner of the present invention may be any one of positive and negative; provided that the toner of the present invention is preferably a negatively chargeable toner because a polyester resin itself has high negative chargeability and the binder resin containing a polyester resin is preferable embodiment herein.

A fluidity improver other than the inorganic fine powder having the above properties may be used as a fluidity improver in the toner of the present invention. Any improver can be used as the fluidity improver as long as the improver can improve fluidity as compared to that before external addition to toner particles. Examples of the fluidity improver include: a fluorine resin powder such as a vinylidene fluoride fine powder or a polytetrafluoroethylene fine powder; fine powdered silica such as silica obtained through a wet process or silica obtained through a dry process; and treated silica obtained by treating the surface of any one of the above-mentioned silicas with a silane coupling agent, a titanium coupling agent, silicone oil, or the like. A preferable fluidity improver is a fine powder produced through the vapor phase oxidation of a silicon halide compound, the fine powder being called dry process silica or fumed silica. That is, the dry process silica or fumed silica is produced by means of a conventionally known technique. For example, the production utilizes a thermal decomposition oxidation reaction in oxygen and hydrogen of a silicon tetrachloride gas, and a basic reaction formula for the reaction is represented by the following formula:

$$SiCl_4+2H_2+O_2 \rightarrow SiO_2+4HCl$$

A composite fine powder of silica and any other metal oxide can also be obtained by using a silicon halide compound with any other metal halide compound such as aluminum chloride or titanium chloride in the production step, and silica comprehends the composite fine powder as well. A silica fine powder having an average primary particle size in the range of preferably from 0.001 μm or more and to 2.000 μm or less, or particularly preferably from 0.002 μm or more and to 0.200 μm or less is desirably used.

Examples of a commercially available silica fine powder produced through the vapor phase oxidation of a silicon halide compound include those commercially available under the following trade names.

That is: AEROSiL (NIPPON AEROSIL Co., Ltd.) 130, 200, 300, 380, TT600, MOX170, MOX80, COK84; Ca—O—SiL (CABOT Co.) M-5, MS-7, MS-75, HS-5, EH-5; Wacker HDK N 20 (WACKER-CHEMIE GNBH), V15, N20E, T30, T40; D-CFine Silica (DOW CORNING Co.); and Fransol (Francil)

Further, a treated silica fine powder obtained by subjecting the silica fine powder produced through the vapor phase oxidation of a silicon halide compound to a hydrophobic treatment is preferably used. The treated silica fine powder is particularly preferably obtained by treating the silica fine powder in such a manner that the degree of hydrophobicity titrated by a methanol titration test (methanol wettability; an index showing wettability to methanol) shows a value in the range of from 30 or more and to 80 or less.

Hydrophobicity is imparted by chemically treating the silica fine powder with, for example, an organic silicon compound that reacts with, or physically adsorbs to, the silica fine powder. A preferable method involves treating the silica fine powder produced through the vapor phase oxidation of a silicon halide compound with an organic silicon compound. Examples of the organic silicon compound include hexamethyldisilazane, trimethylsilane, triaxethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysiline, diphenyldiethoxysilane, 1-hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. One of those compounds is used alone or mixture of two or more thereof is used.

The fluidity improver may be treated with silicone oil, or may be treated together with the above-mentioned hydrophobic treatment.

Silicone oil having a viscosity of from 30 $mm^2/s$ or more and to 1,000 $mm^2/s$ or less at 25° C. is preferably used. Examples of particularly preferable silicone oil include dimethyl silicone oil, methylphenyl silicone oil, α-methylstyrene-modified silicone oil, chlorophenryl silicone oil, and fluorine-modified silicone oil.

Examples of a method for treatment with silicone oil include: a method involving directly mixing a silica fine powder treated with a silane coupling agent and silicone oil by using a mixer such as a Henschel mixer; a method involving spraying a silica fine powder serving as a base with silicone oil; and a method involving dissolving or dispersing silicone oil into an appropriate solvent, and adding and mixing a silica fine powder to and with the solution to remove the solvent. After silica has been treated with silicone oil, the temperature of the silica treated with silicone oil is preferably heated to 200° C. or higher (more preferably 250° C. or higher) in an inert gas so that the coat on the surface of silica is stabilized.

One of nitrogen atom-containing silane coupling agents such as aminopropyltrimethoxysilane, aminopropyltriethoxysilane, dimethylaminopropyltrimethoxysilane, diethylaminopropyltrimrethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmononethoxysilane, dimethylaminophenyltriethoxysilane, trimethoxysilyl-γ-propylphenylamine, and trimethoxysilyl-γ-propylbenzylamine can be used alone or in combination. As a preferable silane coupling agent, there is given hexamethyldisilazane (HMDS).

One obtained by means of a method involving treating silica with a coupling agent in advance and treating the resultant with silicone oil, or a method involving treating silica with a coupling agent and silicone oil simultaneously is preferable.

A fluidity improver having a specific surface area according to nitrogen adsorption measured by means of a BET method of 30 $m^2/g$ or more, or preferably 50 $m^2/g$ or more provides good results.

The fluidity improver is desirably added in an amount of from 0.01 part by mass or more and to 8.00 parts by mass or less, or preferably from 0.10 part by mass or more and to 4.00 parts by mass or less with respect to 100 parts by mass of the toner particles.

In addition, any external additive other than the fluidity improver may be added to the toner of the present invention as required. Examples of the external additive include resin fine particles and inorganic fine particles serving as charging adjuvants, conductivity imparting agents, caking inhibitors, release agents, lubricants, and abrasives. Specifically, lubricants such as Teflon (registered trademark), zinc stearate, and polyvinylidene fluoride can be exemplified, and, of those, polyvinylidene fluoride is preferable. Abrasives such as cerium oxide, silicon carbide, and strontium titanate can be exemplified, and, of those, strontium titanate is preferable. Caking inhibitors, or conductivity imparting agents such as carbon black, zinc oxide, antimony oxide, and tin oxide may also be used. In addition, fine particles opposite in polarity can be used in a small amount as a developability improver.

The amount of the external additive to be mixed with the toner particle is preferably from 0.10 part by mass or more and to 5.00 parts by mass or less with respect to 100 parts by mass of the toner particle.

The toner of the present invention preferably has a weight average particle size of from 3 μm or more and to 10 μm or less in terms of image density, resolution, and the like.

The toner of the present invention can be obtained by: sufficiently mixing a binder resin, a colorant, any other additive as required, and the like by using a mixer such as a Henschel mixer or a ball mill; melting and kneading the obtained mixture by using a heat kneader such as a heat roll, a kneader, or an extruder; cooling the kneaded product to be solidified; and grinding and classifying the solidified product to give toner particles; and sufficiently mixing an inorganic fine powder having the above properties and a desired additive with the resultant by using a mixer such as a Henschel mixer as required.

Examples of a mixer include: a Henschel mixer (manufactured by Mitsui Mining Co., Ltd.); a Super mixer (manufactured by Kawata); a Ribocorn (manufactured by Okawara Corporation); a Nauta mixer, a Turbulizer, and a Cyclomix (manufactured by Hosokawa Micron Corporation); a Spiral pin mixer (manufactured by Pacific Machinery & and Engineering Co., Ltd.); and a LÖDIGE mixer (manufactured by Matsubo Corporation). Examples of the kneader include: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and a Kneader (manufactured by Inoue Manufacturing Co., Ltd.; a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.). Examples of the grinder for the grinding include: a Counter jet mill, a Micronjet, and an Inomizer (manufactured by Hosokawa Micron Corporation); an IDS mill and a PJM jet grinder (manufactured by Nippon Pneumatic Mfg, Co., Ltd.); a Cross jet mill (manufactured by Kurimoto, Ltd.); an Urumax (manufactured by Nisso Engineering Co., Ltd.); an SK Jet O Mill (manufactured by Seishin Enterprise Co., Ltd.); a Kryptron system (manufactured by Kawasaki Heavy Industries); a Turbo mill (manufactured by Turbo Kogyo Co., Ltd.); and a Super rotor (manufactured by Nisshin Engineering Inc.). Examples of a classifier for classifying include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji). Examples of a sieving device, i.e., classifier, to be used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); a Microsifter (manufactured by Makino mfg Co., Ltd.); and a circular vibrating screen.

Methods of measuring the physical properties of the toner of the present invention are as described below. The physical properties described in examples to be described later are based on those methods.

(1) Weight Average Particle Diameter (D4) of Toner

The weight average particle diameters (D4) of the toner were measured with a precision particle size distribution measuring apparatus based on a pore electrical resistance method provided with a 100-μm aperture tube "Coulter Counter Multisizer 3" (registered trademark, manufactured by Beckman Coulter, Inc) and dedicated software included with the apparatus "Beckman Coulter Multisizer 3 Version 3.51" (manufactured by Beckman Coulter, Inc) for setting measurement conditions and analyzing measurement data while the number of effective measurement channels was set to 25,000.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush." function of the analysis software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass-fold is added as a dispersant to the electrolyte solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be from 10° C. or higher and to 40° C. or lower upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight average particle diameter (D4) of the toner are calculated. It should be noted that an "average diameter" on the "analysis/volume statistics (arithmetic average)" screen of the dedicated software when the dedicated software is set to show a graph in a vol % unit is the weight average particle diameter (D4).

(2) Method of Measuring Softening Point of Each of Binder Resin

The softening point of the binder resin is measured by using a flow tester in conformance with JIS K 7210. A specific measurement method is shown below. While 1 $cm^3$ of a sample is heated by using a flow tester (CFT-500, manufactured by Shimadzu Corporation) at a rate of temperature increase of 6° C./min, a load of $19.6\times10^5$ $N/m^2$ (i.e., 20 $kg/cm^2$) is applied to the sample by using a plunger so that a nozzle having a diameter of 1 mm and a length of 1 mm is extruded. A plunger fall out amount (i.e., flow value)-temperature curve is drawn on the basis of the result of the extrusion. The height of the S-shaped curve is represented by h, and the temperature corresponding to h/2 (i.e., the temperature at which one half of a resin flows out) is defined as a softening point.

(3) Measurement of Glass Transition Temperature (Tg) of Binder Resin

The glass transition temperature of the binder resin is measured with a differential scanning calorimeter "Q1000" (manufactured by TA Instruments) in conformity with ASTM D3418-82.

A temperature correction for the detecting portion of the apparatus is performed by using the melting point of each of indium and zinc, and a heat quantity correction for the portion is performed by using the heat of melting of indium.

To be specific, about 10 mg of the binder resin are precisely weighed and loaded into an aluminum pan. The measurement is performed in the measuring range of 30 to 200° C. at a rate of temperature increase of 10° C./min by using an empty aluminum pan as a reference. A change in specific heat is obtained in the temperature range of 40° C. to 100° C. in the temperature increase process. The point of intersection of a line intermediate between base lines before and after the appearance of the change in specific heat and the differential thermal curve in this case is defined as the glass transition temperature (Tg) of the binder resin.

(4) Measurement of Molecular Weight Distribution by GPC

The molecular weight distribution of tetrahydrofuran (THF) soluble matter of a binder resin is measured by gel permeation chromatography (GPC) as described below.

First, the binder resin is dissolved in tetrahydrofuran (THF) at room temperature over 24 hours. Then, the resultant solution is filtrated through a solvent-resistant membrane filter "Maishori Disk" (manufactured by TOSOH CORPORATION) having a pore diameter of 0.2 μm, whereby a sample solution is obtained. It should be noted that the concentration of a component soluble in THF in the sample solution is adjusted to about 0.8 mass %. Measurement is performed by using the sample solution under the following conditions.

Apparatus: HLC8120 GPC (detector: RI) (manufactured by TOSOH CORPORATION)

Column: Shodex KF-801, 802, 803, 804, 805, 806, 807 (manufactured by SHOWA DENKO K.K.)

Elution solution: tetrahydrofuran (THF)

Flow rate: 1.0 ml/minute

Oven temperature: 40.0° C.

Sample injection amount: 0.10 ml

Upon calculation of the molecular weight of the sample, a molecular weight calibration curve prepared with a standard polystyrene resin (such as a product available under the trade name "TSK Standard Polystyrene F-850, F-450, F-288, F-128, F-80, F-40, F-20, F-10, F-4, F-2, F-1, A-5000, A-2500, A-1000, or A-500" from TOSOH CORPORATION) is used.

(5) Measurement of Content of Tetrahydrofuran (THF) Insoluble Matter of Binder Resin The content of the tetrahydrofuran (THF) insoluble matter of the binder resin is measured as described below.

About 1.0 g of the binder resin is weighed (W1 [g]). The weighed resin is placed in extraction thimble (such as a product available from Advantec Toyo under the tradename "No. 86R" (measuring 28×100 mm)) which has been weighted in advance, and is set in a Soxhlet extractor so as to be extracted with 200 ml of tetrahydrofuran (THF) as a solvent for 16 hours; in this case, the extraction is performed at such a reflux speed that the cycle of the extraction with the solvent is once per about five minutes. After the completion of the extraction, the extraction thimble is taken out and air-dried. After that, the extraction thimble is dried in a vacuum at 40° C. for 8 hours, and the mass of the extraction thimble containing an extraction residue is weighed. The mass (W2 [g]) of the extraction residue is calculated by subtracting the mass of the extraction thimble from the above weighed mass.

Then, the content of the THF insoluble matter of the binder resin can be determined by subtracting the content (W3 [g]) of a component except the binder resin component as represented by the following equation (1).

$$\text{Content of THF insoluble matter (mass \%)}=\{(W2-W3)/(W1-W3)\}\times 100 \quad (1)$$

DESCRIPTION OF THE EMBODIMENTS

The basic constitution and characteristics of the present invention have been described above. Subsequently, the present invention is specifically described on the basis of the following examples. However, no embodiment of the present invention is limited by the examples. It should be noted that terms "part(s)" in the following formulations mean "part(s) by mass" unless otherwise stated.

<Production Example of Inorganic Fine Powder 1>

105 g of aluminum sulfate (JIS product No. 1 for water line, $Al_2O_3$ content: 16.5%) and 125 g of anhydrous sodium sulfate (first-grade reagent) were loaded into a 2-L glass beaker, and 800 g of water were added to dissolve them, whereby a mixed solution of aluminum sulfate and sodium sulfate having a pH of 3.2 was obtained. A 30% sodium hydroxide solution was dropped to the above solution while the above solution was stirred, whereby an opaque suspension having a pH of 4 was obtained. The suspension was heated to and maintained at 95° C., and its pH was measured once per 1.5 minutes. While a 30% sodium hydroxide solution was dropped to the suspension to keep the pH at 4, the mixture was continuously heated and stirred at a stirring speed of 300 rpm for 5 hours, whereby a white precipitate was obtained. The precipitate was separated by filtration, washed with water at 40° C. twice and with water at 15° C. twice, and dried in a thermostatic dryer at 110° C. for 12 hours, whereby Inorganic Fine Powder 1 was obtained.

<Production Examples of Inorganic Fine Powders 2 to 8>

Inorganic Fine Powders 2 to 8 were each obtained in the same manner as in the production example of Inorganic Fine Powder 1 except that the stirring speed and the like were changed as shown in Table 1.

TABLE 1

Methods of producing inorganic fine powders

| Inorganic Fine Powder | Stirring speed rpm | Frequency at which pH is adjusted (Every . . . minutes) | Number of times of washing: Water at 40° C. | Number of times of washing: Water at 15° C. | Drying: Temperature (° C.) | Drying: Time (h) |
|---|---|---|---|---|---|---|
| 1 | 300 | 15 | 2 | 2 | 110 | 12 |
| 2 | 200 | 15 | 2 | 2 | 110 | 12 |
| 3 | 400 | 15 | 2 | 2 | 110 | 12 |
| 4 | 300 | 5 | 4 | 2 | 110 | 16 |
| 5 | 300 | 30 | 2 | 2 | 100 | 12 |
| 6 | 300 | 60 | 2 | 2 | 110 | 12 |
| 7 | 300 | 15 | 6 | 3 | 120 | 16 |
| 8 | 400 | 30 | 4 | 2 | 110 | 16 |

<Production Example of Inorganic Fine Powder 9>

100 parts by mass of Inorganic Fine Powder 1 were loaded into a reaction vessel, and, under a nitrogen atmosphere, a dilute solution prepared by dissolving 100 parts by mass of hexamethyldisilazane in 900 parts by mass of hexane was gradually dropped to the powder while the powder was stirred. The powder and the solution were stirred for an additional 10 minutes, whereby a mixture was obtained. After that, the mixture was centrifuged, and the precipitate was separated. After that, the mixture was dried at 150° C. for 12 hours, whereby Inorganic Fine Powder 9 was obtained.

<Production Example of Inorganic Fine Powder 10>

A block copolymer of ethylene glycol and propylene glycol (Pluronic-P123 manufactured by BASF) was dissolved in ion-exchanged water, whereby a 20-mass % surfactant solution was obtained. 100 g of the surfactant solution, 44 g of 25-mass % sulfuric acid, and 125 g of ion-exchanged water were mixed, whereby a transparent liquid was obtained. 135 g of sodium silicate (containing 15 mass % of $SiO_2$ and 5.1 mass % of $Na_2O$) were gradually added to the liquid while the liquid was stirred, whereby an opaque reaction mixture was obtained. The reaction mixture had a pH of 3.0.

The temperature of the reaction mixture was held at 30° C. for 10 hours while the reaction mixture was stirred. After that, the temperature was increased to 80° C., and was held at the temperature for 16 hours, whereby silica particles having the surfactant present in each of their pores were produced. Further, a pot made of polystyrene was filled with 400 g of the above reaction mixture and 1,000 g of zirconia beads each having a diameter of 5 mm, and was tightly stopped in a state where no dead volume was present in the pot. After that, the mixed liquid was subjected to wet pulverization with a bead mill.

Next, the treated liquid was centrifuged, whereby a precipitate was obtained. After that, the precipitate was dispersed in ethanol so that the concentration of the silica particles might be 1 mass %. After having been stirred while being heated, the dispersed product was centrifuged so that the precipitate was recovered. The stirring in ethanol and the recovery of the precipitate by centrifugation were repeated again, whereby the surfactant was removed. The remainder was dried at 80° C. for 16 hours, whereby Inorganic Fine Powder 10 was obtained.

<Production Example of Inorganic Fine Powder 11>

Inorganic Fine Powder 11 was obtained in the same manner as In the production example of Inorganic Fine Powder 10 except that the drying was performed at 120° C. for 16 hours.

<Production Example of Inorganic Fine Powder 12>

A block copolymer of ethylene glycol and propylene glycol (Pluronic-P123 manufactured by BASF) was dissolved in ion-exchanged water, whereby a 10-mass % surfactant solution was obtained. 210 g of the surfactant solution, 59 g of 25-mass % sulfuric acid, and 291 g of ion-exchanged water were mixed, whereby a transparent liquid was obtained. 140 g of sodium silicate (containing 15 mass % of $SiO_2$ and 5.1 mass % of $Na_2O$) were gradually added to the liquid while the liquid was stirred, whereby an opaque reaction mixture was obtained. The reaction mixture had a pH of 1.0.

The temperature of the reaction mixture was held at 30° C. for 10 hours while the reaction mixture was stirred. After that, the temperature was increased to 80° C., and was held at the temperature for 16 hours, whereby silica particles having the surfactant present in each of their pores were produced.

Next, the treated liquid was centrifuged, whereby a precipitate was obtained. After that, the precipitate was dispersed in ethanol so that the concentration of the silica particles might be 1 mass %. After having been stirred while being heated, the dispersed product was centrifuged so that the precipitate was recovered. The stirring in ethanol and the recovery of the precipitate by centrifugation were repeated again, whereby the surfactant was removed.

Further, the above silica particles were dispersed in ion-exchanged water. A pot made of polystyrene was filled with 400 g of the dispersion liquid and 1,000 g of zirconia beads each having a diameter of 5 mm, and was tightly stopped in a state where no dead volume was present in the pot. After that, the resultant was subjected to wet pulverization with a bead mill. After that, the precipitate was recovered by centrifugation, and was then dried at 80° C. for 16 hours, whereby Inorganic Fine Powder 12 was obtained.

<Production Example of Inorganic Fine Powder 13>

A mixture of aluminum tri-sec-butoxide ($Al(O\text{-}sec\text{-}Bu)_3$) (21.9 g, 89.0 mmol), 1-propanol (120 g, 2.00 mol), and deionized water (5.15 g, 286 mmol) was vigorously stirred for 1 hour at room temperature. After that, a solution of lauric acid (5.40 g, 27.0 mmol) in 1-propanol (17.5 g, 290 mmol) was added to the mixture, and the resultant mixture was stirred at room temperature for an additional 24 hours. The resultant white liquid was transferred to a 300-mL autoclave, and was heated at 110° C. for 48 hours without being stirred, whereby a white precipitate was obtained. The precipitate was washed on filter paper with ethanol, and was then dried in a stream of $N_2$ at room temperature. A white solid thus obtained was heated in a stream of $N_2$ from room temperature to 600° C. at a rate of temperature increase of 20° C./min, and was then baked at 650° C. for 5 hours in a stream of the air so that organic matter was burnt. Thus, Inorganic Fine Powder 13 was obtained.

<Production Example of Inorganic Fine Powder 14>

Inorganic Fine Powder 14 was obtained in the same manner as in the production example of Inorganic Fine Powder 13 except that the rate of temperature increase at the time of the baking was changed to 10° C./min, and the temperature at which the baking was performed was changed to 600° C.

<Production Example of Inorganic Fine Powder 15>

105 g of aluminum sulfate (JIS product No. 1 for water line, $Al_2O_3$ content: 16.5%) and 125 g of anhydrous sodium sulfate (first-grade reagent) were loaded into a 2-L glass beaker, and 800 g of water were added to dissolve them, whereby a mixed solution of aluminum sulfate and sodium sulfate having a pH of 3.2 was obtained. A 20% sodium hydroxide solution was dropped to the above solution while the above solution was stirred, whereby an opaque suspension having a pH of 3.8 was obtained. The suspension was heated to and maintained at 95° C. at a stirring speed of 300 rpm for 10 hours, whereby a white precipitate was obtained. The precipitate was separated by filtration, washed with water at 15° C. once and with water, and dried in a thermostatic dryer at 110° C. for 6 hours, whereby Inorganic Fine Powder 15 was obtained.

<Production Example of Inorganic Fine Powder 16>

0.12 $m^3$ of sodium silicate ($SiO_2/Na_2O$ molar ratio 3.08, $SiO_2$ concentration 28.32 mass %, $Al_2O_3$ 0.1 mass %) and 0.88 $m^3$ of water were loaded into a 2-$m^3$ reaction vessel with a stirring blade based on a steam heating system. While the temperature of the aqueous solution was held at 40° C., the following first acid addition treatment was performed: 0.11 $m^3$ of 22-mass % sulfuric acid was added to the aqueous solution over 10 minutes so that a neutralization ratio might be 60%. Next, steam was blown into a reaction liquid obtained by the first acid addition treatment so that the temperature of the liquid was increased to 70° C. over 20 minutes. While the reaction liquid was stirred, the temperature was held at 70° C., and the reaction liquid was left to stand for 15 minutes, whereby an aging treatment for growing silica particles was performed. Further, the following second acid addition treatment was performed: while the reaction liquid after the aging treatment was stirred, 0.01 $m^3$ of 22-mass % sulfuric acid was added to the reaction liquid over 30 minutes to set the final pH of the reaction liquid to 3.0. Next, the reaction liquid after the second acid addition treatment was filtrated with a filter press, and was then washed with water and dried in a thermostatic dryer. After that, the dried product was shredded with an air pulverizer, and then the shredded products were classified, whereby Inorganic Fine Powder 16 was obtained.

<Production Example of Inorganic Fine Powder 17>

2.18 L of water, 7 L of methanol, and 1.0 kg of a 28% aqueous solution of ammonia were loaded into a 30-L reactor made of glass provided with a stirring machine, a dropping port, and a temperature gauge, whereby an ammonia mixed liquid was prepared. The temperature of the mixed liquid was adjusted to 40° C.±0.5° C., and a mixed liquid of 912 g of tetramethoxysilane as a silane compound and 1.2 L of methanol was dropped to the above mixed liquid to perform hydrolysis in a state where the above mixed liquid was stirred and the temperature inside the reactor was kept at 40° C. Thus, a suspension of silica fine particles was obtained. Further, the fine particles were baked at 250° C., whereby Inorganic Fine Powder 17 was obtained.

Table 2 shows physical properties of the above-mentioned Inorganic Fine Powders 1 to 17.

In addition, as the inorganic fine powders, prepared were the following.

AEROXIDE Alu C (alumina, manufactured by Japan Aerosil Co., Ltd.)

TM-100J (transition alumina, manufactured by TAIMEI CHEMICALS CO., LTD.)

TM-300 (transition alumina, manufactured by TAIMEI CHEMICALS CO., LTD.)

TABLE 2

Physical properties of inorganic fine powders

| Inorganic Fine Powder | Kind | Pore volume A $cm^3/g$ | Pore volume B $cm^3/g$ | A/B — | BET specific surface area $m^2/g$ | Particle diameter (D50) μm |
|---|---|---|---|---|---|---|
| 1 | Alunite | $1.30 \times 10^{-1}$ | $1.50 \times 10^{-1}$ | 0.87 | 280.0 | 1.00 |
| 2 | Alunite | $1.00 \times 10^{-1}$ | $1.20 \times 10^{-1}$ | 0.83 | 163.0 | 2.00 |
| 3 | Alunite | $1.10 \times 10^{-1}$ | $1.30 \times 10^{-1}$ | 0.85 | 350.0 | 0.50 |
| 4 | Alunite | $3.50 \times 10^{-1}$ | $3.50 \times 10^{-1}$ | 1.00 | 387.0 | 1.00 |
| 5 | Alunite | $4.00 \times 10^{-2}$ | $6.00 \times 10^{-2}$ | 0.67 | 74.0 | 1.00 |
| 6 | Alunite | $8.00 \times 10^{-1}$ | $1.40 \times 10^{-1}$ | 0.57 | 220.0 | 1.00 |
| 7 | Alunite | $4.50 \times 10^{-1}$ | $6.00 \times 10^{-1}$ | 0.75 | 612.0 | 1.00 |
| 8 | Alunite | $1.30 \times 10^{-1}$ | $3.90 \times 10^{-1}$ | 0.33 | 520.0 | 0.50 |
| 9 | Alunite | $1.10 \times 10^{-1}$ | $1.30 \times 10^{-1}$ | 0.87 | 200.0 | 1.00 |
| 10 | Silica | $3.60 \times 10^{-1}$ | $5.10 \times 10^{-1}$ | 0.71 | 380.0 | 1.50 |
| 11 | Silica | $8.70 \times 10^{-1}$ | 1.21 | 0.72 | 900.0 | 1.00 |
| 12 | Silica | $9.00 \times 10^{-2}$ | $4.30 \times 10^{-1}$ | 0.21 | 300.0 | 1.00 |
| 13 | Alumina | $4.10 \times 10^{-1}$ | $5.30 \times 10^{-1}$ | 0.78 | 300.0 | 1.00 |
| 14 | Alumina | $9.20 \times 10^{-1}$ | 1.13 | 0.88 | 490.0 | 1.00 |
| 15 | Alunite | $8.00 \times 10^{-2}$ | $1.60 \times 10^{-1}$ | 0.50 | 8.0 | 1.50 |
| 16 | Silica | 1.20 | 1.55 | 0.77 | 520.0 | 1.50 |
| 17 | Silica | 0 | $4.00 \times 10^{-1}$ | 0.00 | 29.2 | 0.12 |
| AEROXIDE Alu C | Alumina | $5.00 \times 10^{-2}$ | $2.50 \times 10^{-1}$ | 0.19 | 100.0 | 0.15 |
| TM300 | Alumina | $1.70 \times 10^{-1}$ | 1.13 | 0.15 | 198.2 | 4.47 |
| TM100J | Alumina | $3.00 \times 10^{-2}$ | $7.40 \times 10^{-1}$ | 0.03 | 114.7 | 5.34 |

<Production Example of Binder Resin 1(H)>

| | |
|---|---|
| Propoxylated bisphenol A (2.2-mol adduct): | 25.0 mol % |
| Ethoxylated bisphenol A (2.2-mol adduct): | 25.0 mol % |
| Terephthalic acid: | 32.0 mol % |
| Trimellitic anhydride: | 6.0 mol % |
| Adipic acid | 4.5 mol % |

-continued

| | |
|---|---|
| Acrylic acid | 4.5 mol % |
| Fumaric acid | 2.5 mol % |

The above polyester monomers were loaded into a four-necked flask together with an esterifying catalyst. The flask was mounted with a decompression apparatus, a water separation apparatus, a nitrogen gas-introducing apparatus, a temperature-measuring apparatus, and a stirring apparatus, and the mixture was stirred under a nitrogen atmosphere at 135° C. A mixture of a vinyl monomer (containing 83 mol % of styrene and 15 mol % of 2-ethylhexyl acrylate) and 2 mol % of benzoyl peroxide as a polymerization initiator was dropped to the mixture from a dropping funnel over 4 hours. After that, the mixture was subjected to a reaction at 135° C. for 5 hours, and 0.5 mol % fumaric acid was added. Then, the resultant was subjected to a polycondensation reaction while a temperature was increased to 230° C. After the completion of the reaction, the resultant was taken out of the container, and was cooled. After that, the cooled product was pulverized, whereby Binder Resin 1(H) was obtained.

Table 3 shows the physical properties of Binder Resin 1(H)

<Production Example of Binder Resin 1(L)>

| | |
|---|---|
| Terephthalic acid: | 32 mol % |
| Trimellitic acid: | 8 mol % |
| Propoxylated bisphenol A (2.2-mol adduct): | 34 mol % |
| Ethoxylated bisphenol A (2.2-mol adduct): | 26 mol % |

The above polyester monomers were loaded into a four-necked flask together with an esterifying catalyst. The flask was mounted with a decompression apparatus, a water separation apparatus, a nitrogen gas-introducing apparatus, a temperature-measuring apparatus, and a stirring apparatus, and the mixture was stirred under a nitrogen atmosphere at 135° C. A mixture of a vinyl monomer (containing 83 mol % of styrene and 15 mol % of 2-ethylhexyl acrylate) and 2 mol % of benzoyl peroxide as a polymerization initiator was dropped to the mixture from a dropping funnel over 4 hours.

After that, the mixture was subjected to a reaction at 135° C. for 5 hours, and then the resultant was subjected to a polycondensation reaction while a reaction temperature at the time of the polycondensation was increased to 230° C. After the completion of the reaction, the resultant was taken out of the container, and was cooled. After that, the cooled product was pulverized, whereby Binder Resin 1(L) was obtained.

Table 3 shows the physical properties of Binder Resin 1(L)

<Production example of Binder Resin 1>

Binder Resin 1 was obtained by mixing 70 parts by mass of Binder Resin 1(H) and 30 parts by mass of Binder Resin 1(L) with a Henschel mixer.

<Production Example of Binder Resin 2(H)>

| | |
|---|---|
| Propoxylated bisphenol A (2.2-mol adduct): | 46.8 mol % |
| Terephthalic acid: | 35.0 mol % |
| Trimellitic anhydride: | 11.2 mol % |
| Isophthalic acid: | 6.0 mol % |
| Ethylene oxide adduct of phenol novolac: | 1.0 mol % |

The above monomers were loaded into a 5-1 autoclave together with an esterifying catalyst. The autoclave was mounted with a reflux condenser, a water separation apparatus, an $N_2$ gas-introducing tube, a temperature gauge, and a stirring apparatus, and the mixture was subjected to a polycondensation reaction at 230° C. while an $N_2$ gas was introduced into the autoclave. After the completion of the reaction, the resultant was taken out of the container, and was then cooled and pulverized, whereby Binder Resin 2(H) was obtained. Table 3 shows the physical properties of the resin.

<Production Example of Binder Resin 2(L)>

| | |
|---|---|
| Propoxylated bisphenol A (2.2-mol adduct): | 47.0 mol % |
| Terephthalic acid: | 50.0 mol % |
| Trimellitic anhydride: | 3.0 mol % |

The above monomers were loaded into a 5-1 autoclave together with an esterifying catalyst. The autoclave was mounted with a reflux condenser, a water separation apparatus, an $N_2$ gas-introducing tube, a temperature gauge, and a stirring apparatus, and the mixture was subjected to a polycondensation reaction at 180° C. while an $N_2$ gas was introduced into the autoclave. After the completion of the reaction, the resultant was taken out of the container, and was then cooled and pulverized, whereby Binder Resin 2(L) was obtained. Table 3 shows the physical properties of the resin.

<Production Example of Binder Resin 2>

Binder Resin 2 was obtained by mixing 50 parts by mass of Binder Resin 2(H) and 50 parts by mass of Binder Resin 2(L) with a Henschel mixer.

<Production Example of Binder Resin 3(L)>

300 parts by mass of xylene were charged into a four-necked flask, and the air in the container was sufficiently replaced with nitrogen while xylene was stirred. After that, the temperature inside the flask was increased so that xylene was refluxed.

Under the reflux, first, a mixed liquid of 82 parts by mass of styrene, 18 parts by mass of n-butyl acrylate, and 2 parts by mass of di-tert-butylperoxide was dropped to xylene over 4 hours. The mixture was held for 2 hours so that polymerization was completed. Thus, a solution of Binder Resin 3(L) was obtained.

<Production Example of Binder Resin 3(H)>

300 parts by mass of xylene were charged into a four-necked flask, and the air in the container was sufficiently replaced with nitrogen while xylene was stirred. After that, the temperature inside the flask was increased so that xylene was refluxed.

Under the reflux, first, a mixed liquid of 75 parts by mass of styrene, 25 parts by mass of n-butyl acrylate, 0.005 part by mass of divinylbenzene, and 0.8 part by mass of 2,2-bis(4,4-di-tert-butylperoxycyclohexyl)propane was dropped to xylene over 4 hours. After the entirety of the mixed liquid had been dropped, the mixture was held for 2 hours so that polymerization was completed. Thus, a solution of Binder Resin 3(H) was obtained.

<Production of Binder Resin 3>

200 parts by mass of a solution of Binder Resin 3(L) described above in xylene (corresponding to 30 parts by mass of Binder Resin 3(L) component) were charged into a four-necked flask. The temperature of the solution was increased, and the solution was stirred under reflux. Meanwhile, 200 parts by mass of a solution of Binder Resin 3(H) described above (corresponding to 70 parts by mass of Binder Resin 3(H) component) were charged into another container and refluxed. The solution of Binder Resin 3(L) described above and the solution of Binder Resin 3(H) were mixed under reflux, and then the organic solvent was removed by distillation. The resultant resin was cooled to solidify, and then the solidified resin was pulverized, whereby Binder Resin 3 was obtained. Table 3 shows the physical properties of the binder resin.

TABLE 3

Physical properties of binder resins

| | Peak molecular weight MP | Mw | Mw/Mn | THF insoluble matter | Tg (° C.) | Softening point (° C.) |
|---|---|---|---|---|---|---|
| Binder Resin 1(H) | 8,100 | 62,000 | 7.8 | 39% | 56.0 | 130 |
| Binder Resin 1(L) | 6,300 | 8,200 | 2.1 | 0% | 57.5 | 95 |
| Binder Resin 1 | 7,200 | 45,100 | 5.2 | 28% | 56.5 | 120 |
| Binder Resin 2(H) | 8,000 | 150,000 | 25.3 | 32% | 58.6 | 140 |
| Binder Resin 2(L) | 7,300 | 8,500 | 2.5 | 0% | 59.2 | 98 |
| Binder Resin 2 | 7,600 | 120,000 | 10.2 | 22% | 58.8 | 120 |
| Binder Resin 3(H) | 18,000 | 420,000 | 26.7 | 7% | 62.0 | 137 |
| Binder Resin 3(L) | 12,000 | 16,000 | 3.1 | 0% | 58.1 | 112 |
| Binder Resin 3 | 750,000 (Sub)/15,000 (Main) | 362,000 | 53.6 | 3% | 60.9 | 128 |

Example 1

| | |
|---|---|
| Binder Resin 1 | 100 parts by mass |
| Magnetic iron oxide particles (average particle size of 0.14 μm, Hc = 11.5 kA/m, σs = 90 $Am^2/kg$, σr = 16 $Am^2/kg$) | 75 parts by mass |
| Wax (Fisher Tropsch Wax; melting point of 105° C.) | 4 parts by mass |
| Charge control agent (structural formula I below) | 2 parts by mass |

(Structural formula I)

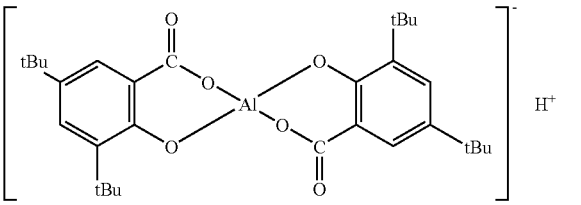

The above-mentioned materials were premixed by using a Henschel mixer. After that, the mixture was melted and kneaded by using a biaxial kneading extruder. At this time, a residence time was controlled in such a manner that the temperature of the kneaded resin would be 150° C. The resultant kneaded product was cooled and coarsely ground by using a hammer mill. After that, the coarsely ground product was ground by using a turbo mill, and the resultant finely ground powder was classified by using a multi-division classifier utilizing a Coanda effect, whereby toner particles having a weight average particle diameter of 6.0 μm were obtained.

1.00 part by mass of a hydrophobic silica fine powder (BET specific surface area 140 $m^2/g$, hydrophobic treatment with 30 parts by mass of hexamethyldisilazane (HMDS) and 10 parts by mass of dimethyl silicone oil with respect to 100 parts by mass of a parent body), 0.20 part by mass of Inorganic Fine Powder 1, and 3.00 parts by mass of strontium titanate (3.0 $m^2/g$) were externally added to and mixed with 100 parts by mass of the toner particles, and the mixture was sieved by using a mesh having an aperture of 150 μm, whereby Toner 1 was obtained.

The following image output evaluation was performed by using Toner 1 thus obtained.

In order that the evaluation might be performed at a high speed and under a condition severe on image smearing, a commercially available copying machine (IR-6570 manufactured by Canon Inc.) reconstructed as described below was used: a drum heater of the machine was turned off, and the print speed of the machine was increased by a factor of 1.7. Then, 500,000-sheet continuous copying was performed by using a test chart having a print percentage of 5% under each of a high-temperature, high-humidity environment (30° C., 80% RH) and a normal-temperature, low-humidity environment (23° C., 5% RH), and evaluation for the following items was performed.

(1) Evaluation for Durable Stability (Durability)

The toner was evaluated for image density as described below. The reflection density of a circular image of 5 mm in diameter was measured with a Macbeth densitometer (manufactured by GretagMacbeth) by using an SPI filter. The toner was evaluated for fogging on the basis of a fogging amount Ds−Dr obtained by subtracting an average reflection density Dr of a transfer material before the formation of an image measured with a reflection densitometer (REFLECTOMETER MODEL TC-6DS manufactured by Tokyo Denshoku CO., LTD.) from a worst value Ds for the reflection density of a white portion after the formation of the image measured with the same reflection densitometer. The evaluation was performed at an initial stage and after the copying on the 500,000 sheets under each test environment. A difference between the density at the initial stage and the density after the copying on the 500,000 sheets, and a difference between fogging after the copying on the 500,000 sheets and fogging at the initial stage were determined, and the evaluation for durable stability was performed on the basis of the differences. The smaller the differences, the more excellent in durable stability the toner is Tables 5 and 6 show the results of the evaluation.

(2) Evaluation for Degree of Deterioration of Toner

The toner in a developing device was collected after the completion of the copying on the 500,000 sheets under the high-temperature, high-humidity environment. Evaluation for extent to which an external additive was embedded in the surface of the toner was performed by measuring and comparing the specific surface areas (BET values) of the toner before and after duration. A ratio of the BET value of the toner after the duration to that of the toner before the duration was represented in a percentage unit, and was used as an indication on which the evaluation for deterioration of the toner was based. It should be noted that a ratio of 81% or more is good in most cases. Table 4 shows the results of the evaluation.

(3) Evaluation for Image Smearing

An image having a print percentage of 5% was continuously copied on each of the 500,000 sheets under the high-temperature, high-humidity environment (30° C., 80% RH). After that, the image evaluation apparatus was turned off once. 3 days after that, the image evaluation apparatus was actuated again, and a lattice pattern in which 4-dot vertical and horizontal lines were printed every 176 dot spaces was output. The extent to which image smearing occurred was determined by observing the print density of each line. In this evaluation, paper using talc as a loading material in which image smearing was apt to occur (having a moisture absorption of 10% at 30.0° C. and 80% RH) was used as paper for evaluation. It should be noted that the moisture absorption of paper was measured with a MOISTREX MX 5000 manufactured by Infrared Engineering. The evaluation was performed on the basis of the following criteria. Table 4 shows the results of the evaluation.

A: No image smearing occurs.

B: Image smearing occurs, but intermittent lines account for a quarter or less of the whole lines.

C: Image smearing occurs, but intermittent lines account for more than a quarter and half or less of the whole lines.

D: A level intermediate between C and E.

E: Image smearing occurs, and a ratio of a portion where no lines are present to the entirety of the image is one third or more.

(4) Evaluation for Contamination of Insides of Developing Assembly and Evaluation Machine After the completion of the copying on the 500,000 sheets under the normal-temperature, low-humidity environment (or at the correct time during the duration), the inside of each of a developing assembly and the evaluation machine was evaluated by visual observation. States where the toner scattered were classified into the following four ranks, and the inside of each of the developing assembly and the evaluation machine was evaluated for contamination on the basis of the ranks. Table 4 shows the results of the evaluation.

A: No toner scattering occurs.
B: Toner scattering occurs near the developing assembly to an extremely slight extent.
C: Toner scattering occurs near the developing assembly to appear as an image defect.
D: The toner scatters even to the main body of the evaluation machine, and an image defect arises.

Examples 2 to 18

Toners 2 to 18 were each obtained in the same manner as in Example 1 except that a prescription shown in Table 4 was adopted. In addition, Tables 4 to 6 show the results of tests similar to those of Example 1 carried out on the toners.

Comparative Examples 1 to 4

Toners 19 to 22 were each obtained in the same manner as in Example 1 except that a prescription shown in Table 4 was adopted. In addition, Tables 4 to 6 show the results of tests similar to those of Example 1 carried out on the toners.

Comparative Examples 5 to 7

Toners 23 to 25 were each obtained in the same manner as in Example 1 except that: a prescription shown in Table 4 was adopted; and an AEROXIDE Alu C (alumina; manufactured by NIPPON AEROSIL CO. LTD.), or a TM100J or TM300 (transition alumina; manufactured by TAIMEI Chemicals Co., Ltd.) was used instead of Inorganic Fine Powder 1. Tables 4 to 6 show the results of tests similar to those of Example 1 carried out on the toners thus obtained.

TABLE 4

Toner prescriptions and results of evaluation

| | Toner No. | Binder Resin | Inorganic Fine Powder Kind | Inorganic Fine Powder Number of parts | Degree of deterioration | Image smearing | Contamination of insides of developing assembly and evaluation machine |
|---|---|---|---|---|---|---|---|
| Example 1 | 1 | 1 | 1 | 0.20 | 92% | A | A |
| Example 2 | 2 | 1 | 2 | 0.20 | 92% | A | A |
| Example 3 | 3 | 1 | 3 | 0.20 | 90% | A | A |
| Example 4 | 4 | 1 | 4 | 0.20 | 87% | A | A |
| Example 5 | 5 | 1 | 5 | 0.20 | 93% | B | A |
| Example 6 | 6 | 2 | 5 | 0.20 | 93% | B | A |
| Example 7 | 7 | 3 | 5 | 0.20 | 93% | B | A |
| Example 8 | 8 | 2 | 5 | 0.90 | 93% | A | A |
| Example 9 | 9 | 2 | 5 | 0.08 | 93% | C | A |
| Example 10 | 10 | 1 | 6 | 0.20 | 93% | B | A |
| Example 11 | 11 | 1 | 7 | 0.20 | 83% | A | A |
| Example 12 | 12 | 1 | 8 | 0.20 | 85% | B | A |
| Example 13 | 13 | 1 | 9 | 0.20 | 92% | A | A |
| Example 14 | 14 | 1 | 10 | 0.20 | 87% | A | A |
| Example 15 | 15 | 1 | 11 | 0.20 | 81% | A | A |
| Example 16 | 16 | 1 | 12 | 0.20 | 93% | C | A |
| Example 17 | 17 | 1 | 13 | 0.20 | 87% | A | A |
| Example 18 | 18 | 1 | 14 | 0.20 | 83% | A | A |
| Comparative Example 1 | 19 | 2 | — | — | 92% | E | C |
| Comparative Example 2 | 20 | 2 | 15 | 0.20 | 91% | D | C |
| Comparative Example 3 | 21 | 2 | 16 | 0.20 | 72% | D | B |
| Comparative Example 4 | 22 | 2 | 17 | 0.20 | 91% | E | B |
| Comparative Example 5 | 23 | 2 | AEROXIDE Alu C | 0.20 | 88% | E | B |
| Comparative Example 6 | 24 | 2 | TM300 | 0.20 | 86% | E | D |
| Comparative Example 7 | 25 | 2 | TM100 J | 0.20 | 88% | E | D |

TABLE 5

| Results of evaluation under high-temperature, high-humidity environment | | | | | |
|---|---|---|---|---|---|
| | | Durability (30° C., 80% RH) | | | |
| | Toner No. | Density on 500,000-th sheet | Density difference | Fogging on 500,000-th sheet | Fogging difference |
| Example 1 | 1 | 1.45 | 0.01 | 0.40 | 0.05 |
| Example 2 | 2 | 1.43 | 0.02 | 0.42 | 0.05 |
| Example 3 | 3 | 1.43 | 0.02 | 0.40 | 0.05 |
| Example 4 | 4 | 1.41 | 0.03 | 0.40 | 0.05 |
| Example 5 | 5 | 1.38 | 0.08 | 0.70 | 0.10 |
| Example 6 | 6 | 1.35 | 0.12 | 0.70 | 0.10 |
| Example 7 | 7 | 1.33 | 0.15 | 0.71 | 0.10 |
| Example 8 | 8 | 1.31 | 0.17 | 0.71 | 0.11 |
| Example 9 | 9 | 1.35 | 0.12 | 0.70 | 0.10 |
| Example 10 | 10 | 1.40 | 0.05 | 0.45 | 0.05 |
| Example 11 | 11 | 1.39 | 0.04 | 0.41 | 0.06 |
| Example 12 | 12 | 1.37 | 0.06 | 0.42 | 0.05 |
| Example 13 | 13 | 1.44 | 0.02 | 0.41 | 0.05 |
| Example 14 | 14 | 1.37 | 0.10 | 0.40 | 0.05 |
| Example 15 | 15 | 1.31 | 0.17 | 0.41 | 0.06 |
| Example 16 | 16 | 1.33 | 0.12 | 0.44 | 0.06 |
| Example 17 | 17 | 1.36 | 0.10 | 0.40 | 0.05 |
| Example 18 | 18 | 1.32 | 0.12 | 0.42 | 0.05 |
| Comparative Example 1 | 19 | 1.13 | 0.25 | 2.35 | 0.51 |
| Comparative Example 2 | 20 | 1.26 | 0.22 | 1.45 | 0.32 |
| Comparative Example 3 | 21 | 1.28 | 0.19 | 1.35 | 0.33 |
| Comparative Example 4 | 22 | 1.08 | 0.23 | 2.10 | 0.41 |
| Comparative Example 5 | 23 | 1.18 | 0.22 | 2.21 | 0.43 |
| Comparative Example 6 | 24 | 1.18 | 0.22 | 2.18 | 0.41 |
| Comparative Example 7 | 25 | 1.16 | 0.23 | 2.31 | 0.45 |

TABLE 6

| Results of evaluation under normal-temperature, low-humidity environment | | | | | |
|---|---|---|---|---|---|
| | | Durability (23° C., 5% RH) | | | |
| | Toner No. | Density on 500,000-th sheet | Density difference | Fogging on 500,000-th sheet | Fogging difference |
| Example 1 | 1 | 1.45 | 0.01 | 0.50 | 0.10 |
| Example 2 | 2 | 1.43 | 0.02 | 0.53 | 0.12 |
| Example 3 | 3 | 1.43 | 0.02 | 0.50 | 0.10 |
| Example 4 | 4 | 1.42 | 0.03 | 0.50 | 0.10 |
| Example 5 | 5 | 1.39 | 0.08 | 1.00 | 0.50 |
| Example 6 | 6 | 1.36 | 0.12 | 1.00 | 0.50 |
| Example 7 | 7 | 1.32 | 0.14 | 1.03 | 0.50 |
| Example 8 | 8 | 1.30 | 0.16 | 1.04 | 0.51 |
| Example 9 | 9 | 1.36 | 0.12 | 1.00 | 0.50 |
| Example 10 | 10 | 1.40 | 0.06 | 0.53 | 0.11 |
| Example 11 | 11 | 1.40 | 0.05 | 0.52 | 0.12 |
| Example 12 | 12 | 1.37 | 0.10 | 0.53 | 0.11 |

TABLE 6-continued

| Results of evaluation under normal-temperature, low-humidity environment | | | | | |
|---|---|---|---|---|---|
| | | Durability (23° C., 5% RH) | | | |
| | Toner No. | Density on 500,000-th sheet | Density difference | Fogging on 500,000-th sheet | Fogging difference |
| Example 13 | 13 | 1.43 | 0.02 | 0.50 | 0.10 |
| Example 14 | 14 | 1.38 | 0.08 | 0.50 | 0.10 |
| Example 15 | 15 | 1.30 | 0.17 | 0.51 | 0.12 |
| Example 16 | 16 | 1.32 | 0.13 | 0.51 | 0.13 |
| Example 17 | 17 | 1.37 | 0.08 | 0.50 | 0.10 |
| Example 18 | 18 | 1.32 | 0.13 | 0.52 | 0.16 |
| Comparative Example 1 | 19 | 1.15 | 0.20 | 2.67 | 1.20 |
| Comparative Example 2 | 20 | 1.27 | 0.18 | 1.65 | 0.51 |
| Comparative Example 3 | 21 | 1.29 | 0.18 | 1.55 | 0.50 |
| Comparative Example 4 | 22 | 1.17 | 0.23 | 2.30 | 0.53 |
| Comparative Example 5 | 23 | 1.23 | 0.18 | 2.41 | 0.55 |
| Comparative Example 6 | 24 | 1.25 | 0.17 | 2.48 | 0.51 |
| Comparative Example 7 | 25 | 1.21 | 0.15 | 2.51 | 0.55 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-293065, filed Nov. 12, 2007, which is hereby incorporated by reference herein in its entirety.

What is claimed is:

1. A toner, comprising:

toner particles each comprising a binder resin and a colorant; and an inorganic fine powder, wherein the inorganic fine powder comprises an alunite type compound and has a ratio (A/B) of a total pore volume A measured in a pore diameter range of from 1.9 nm or more and to 8.0 nm or less to a total pore volume B measured in a pore diameter range of from 1.9 nm or more and to 300.0 nm or less of from 0.20 or more and to 1.00 or less, and the total pore volume A is from $1.00\times10^{-2}$ $cm^3/g$ or more and to 1.00 $cm^3/g$ or less.

2. A toner according to claim 1, wherein the ratio (A/B) of the total pore volume A of the inorganic fine powder to the total pore volume B of the inorganic fine powder is from 0.60 or more and to 1.00 or less.

3. A toner according to claim 1, wherein a specific surface area (BET value) of the inorganic fine powder is from 10.0 $m^2/g$ or more and to 400.0 $m^2/g$ or less.

* * * * *